US005413242A

United States Patent [19]

Orange

[11] Patent Number: 5,413,242

[45] Date of Patent: May 9, 1995

[54] TIGHT CONTAINER AND ASSEMBLY OF SAID CONTAINER AND AN APPROPRIATE SUPPORT

[76] Inventor: Christian Orange, La Luzerne De Haut, 50260 - Bricquebec, France

[21] Appl. No.: 273,493

[22] Filed: Jul. 11, 1994

[51] Int. Cl.[6] ..... B65D 55/00

[52] U.S. Cl. ..... 220/592; 250/506.1; 220/614; 220/628

[58] Field of Search ..... 220/592, 587, 4.04, 220/4.12, 4.26, 601, 614, 628, 630; 250/506.1

[56] References Cited

U.S. PATENT DOCUMENTS

| | | | |
|---|---|---|---|
| 2,152,285 | 3/1939 | Schirmer | 220/630 |
| 2,161,155 | 6/1939 | Gettelman | 220/601 |
| 2,255,964 | 9/1941 | Blatto | 220/601 |
| 3,050,207 | 8/1962 | Oxenham | 220/628 |
| 3,972,450 | 8/1976 | Walters | 220/601 |
| 4,577,112 | 3/1986 | Conche et al. . | |
| 4,591,064 | 5/1986 | Gerhard | 220/630 |
| 4,760,268 | 7/1988 | Noe . | |
| 5,320,237 | 6/1994 | Stolzman | 220/601 |

FOREIGN PATENT DOCUMENTS 2237816 5/1991 United Kingdom .

*Primary Examiner*—Joseph Man-Fu Moy

[57] ABSTRACT

A tight container (3) constituted by a cover (4), a receptacle (5), and a fastening part (6) joining them together. The receptacle is subdivided into cavities by radiating partitions and it encircles the cover, while being offset with respect thereto. A key or wrench (63) makes it possible to rotate the radiating partition and successful bring the cavities in front of the cover, so that it is possible to successively fill the same when the receptacle is rotating. Specific application to the storage and transportation of nuclear waste.

6 Claims, 4 Drawing Sheets

TIGHT CONTAINER AND ASSEMBLY OF SAID CONTAINER AND AN APPROPRIATE SUPPORT

DESCRIPTION

The invention relates to a tight container, as well as to an assembly constituted by said container and an appropriate support.

The tight containers referred to here are used for the transportation of dangerous products in complete safety and are constituted by a receptacle, a cover and a fastening part joining the two aforementioned parts. The fastening part is provided with means for locking to a wall of a safety enclosure from which is removed the products to be placed in the container. In per se known manner and in particular in the nuclear industry, the wall of the enclosure is formed with an opening sealed by a door to which the container cover is coupled in such a way that they are removed together in order to link the enclosure and the receptacle.

However, the disadvantage of such tight containers is that they are difficult to fill in a correct and rational manner, their volume remaining partly unoccupied. The invention consequently relates to a tight container of the type referred to hereinbefore, but not suffering from this deficiency. For this purpose the receptacle has a circular section offcentred with respect to the cover and more extensive than that of the cover, the receptacle being subdivided into cavities extending over quadrants. Moreover, the radiating partitions defining the cavities are mobile in the receptacle rotating under the action of a control system. Filling consequently consists of successively placing the cavities in front of the cover before opening them.

More specifically, the invention relates to a tight container constituted by a cover, an envelope on an opening of which is mounted the cover, the opening being offcentred from the opening of a median axis of the envelope, and a drum rotating in the envelope about the median axis, the drum being subdivided into offcentred compartments with respect to the opening and which can be successively brought in front of the opening when the drum is rotating, characterized in that the envelope carries a fastening part provided with means for locking to an enclosure wall, the drum being terminated by a disk outside the envelope, centred on the axis and positioned, along the median axis, on a side opposite to the opening, the disk being provided with cutouts for receiving key pins and covering a portion of the envelope provided with other cutouts for receiving key pins able to extend those mentioned hereinbefore.

It is clear that this arrangement is appropriate for a very advantageous use of the container.

In the assembly constituted by the container and an appropriate support, the key or wrench is advantageously placed on the support and is constituted by a spindle rotating in the support, a fork having pins directed towards the cutouts and a wheel for rotating the key, the wheel and the fork being located at opposite ends of the spindle.

Figure 1:
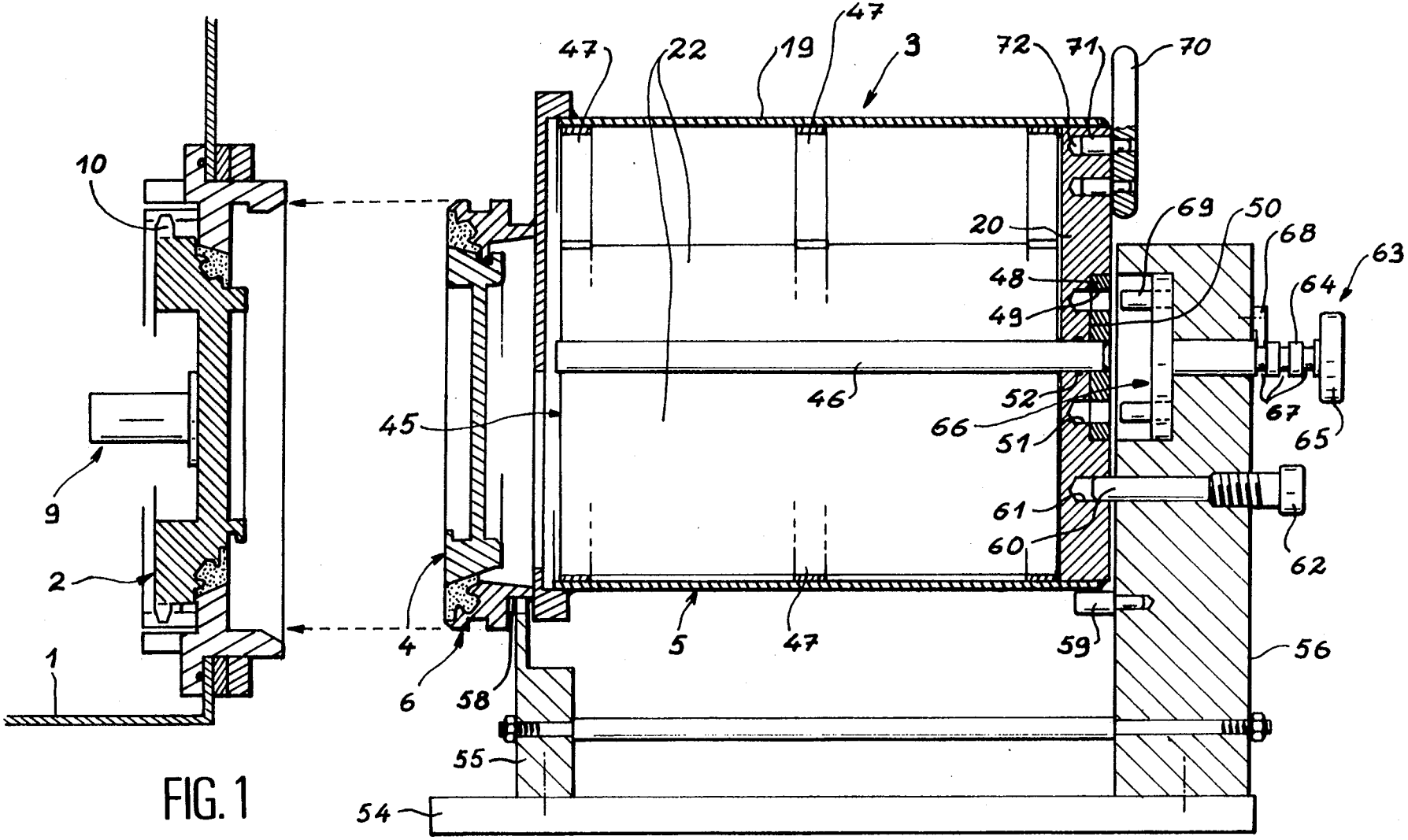

The invention is described in greater detail hereinafter relative to a non-limitative embodiment and the attached drawings, wherein show:

FIG. 1—A longitudinal sectional view of the complete container.

Figure 2:
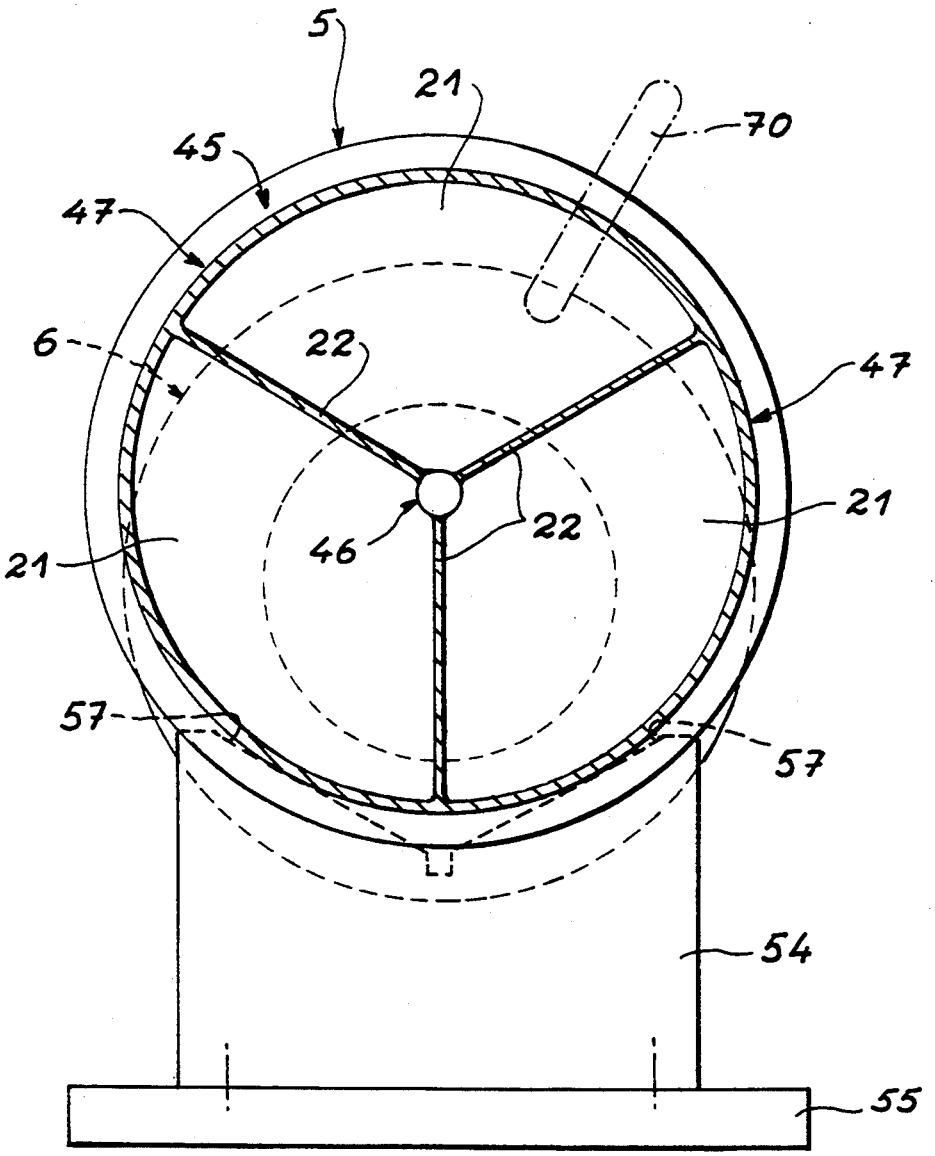

FIG. 2—A cross-sectional view of the receptacle and adjacent elements.

Figure 3:
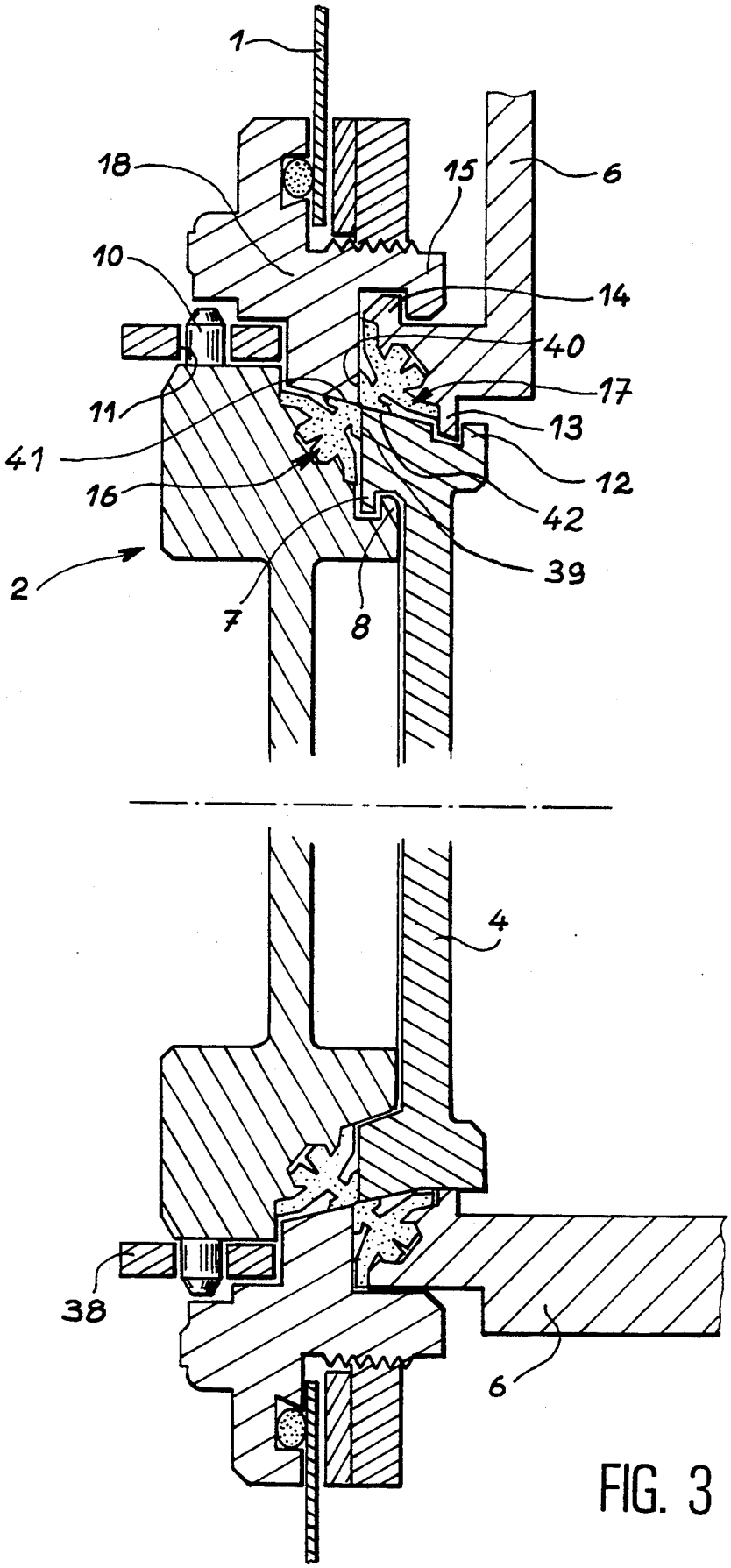

FIG. 3—The coupling of the door and the cover, the wall and the fastening part.

Figure 4:
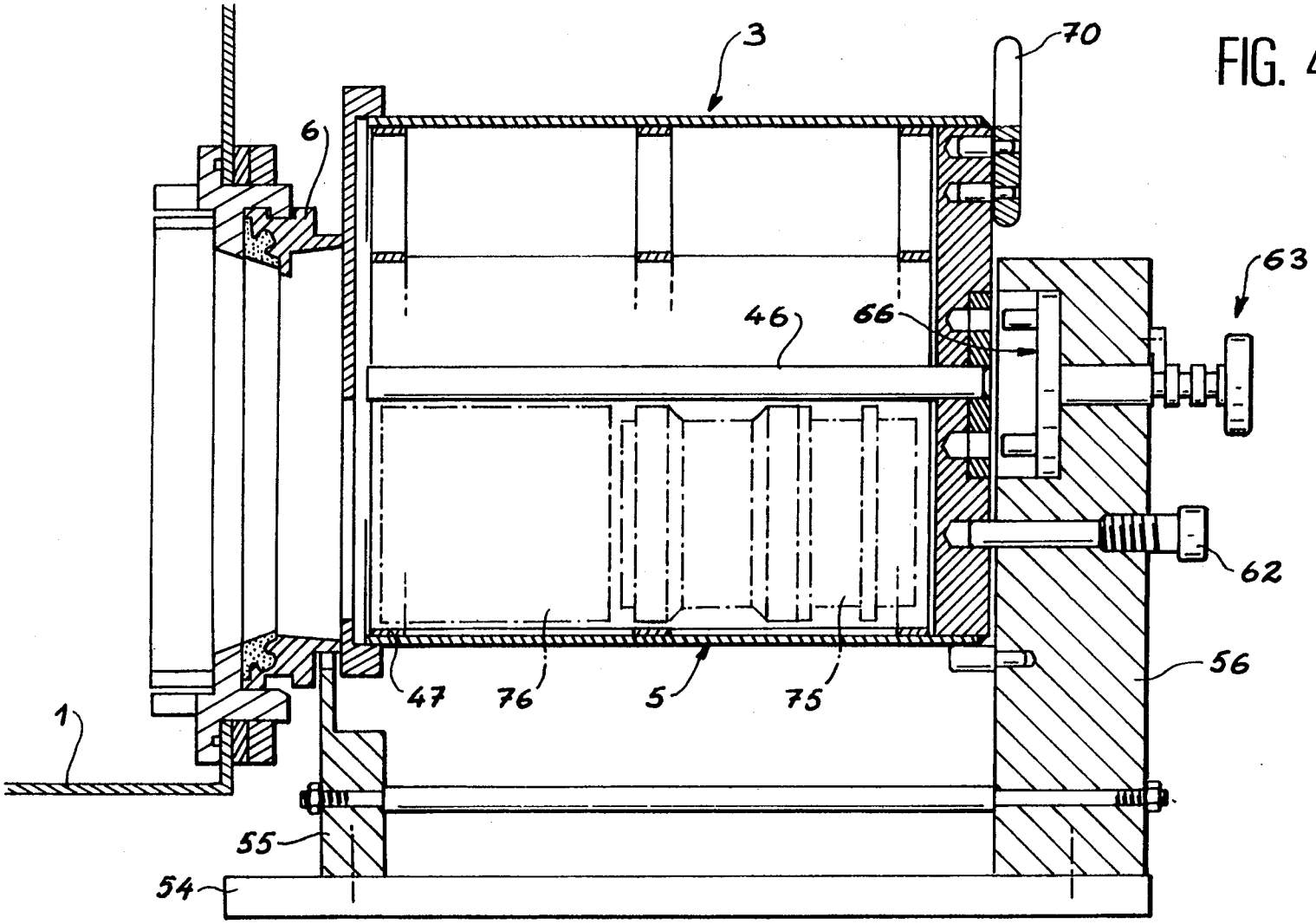

FIG. 4—The filling of one of the cavities.

As illustrated in FIG. 1, an enclosure wall 1 is provided with a door 2 mounted on hinges and in front of which is placed a container 3 according to the invention. The container is formed from a cover 4, a cylindrical receptacle 5 and a fastening part 6 joining the cover 4 to the receptacle.

The manner of locking the container 3 to the enclosure wall 1 and the removal thereof are briefly described hereinafter, because said system is not of an original nature (cf. FIG. 3).

The container 3 is coupled to the enclosure 1 by grips 14, 15, which are fitted into one another by a rotary movement of the fastening part 6. This rotation locks the cover 4 on the enclosure door 2 by means of other grips 7, 8, carried by said parts and which are fitted into one another, and simultaneously unlocks the cover 4 from the fastening part 6, because the other grips 12 and 13 are freed from one another. A rotation of a flange 38 carried by the enclosure wall 1 frees the tenons 10 of the enclosure door 2 secured in grooves 11. This rotation is manually controlled by means of a protective glove fixed to another opening located on another face of the enclosure wall 1.

Communication between the enclosure 1 and the container 3 is established by the opening of the enclosure door 2, manually manipulated by means of the protective glove, using a handle 9 shown in FIG. 1 and located on the door 2 within the enclosure. The enclosure door 2 and the cover 4 remain fixed to one another and hermetically sealed by their surfaces, which look out onto the outside when they are separated, so that said surfaces are never reached by contaminating products, which can dirty the interior of the enclosure and the container 3, particularly in the nuclear industry for which the invention is more particularly intended.

When the filling of the container 3 is completed in the manner to be described hereinafter, the enclosure door 2 to which is fixed the cover 4 is closed by means of the handle 9 and the flange 38 locking the enclosure door by fixing the tenons 10 in the grooves 11 is manually rotated.

A manual rotation of the fastening part 6 unlocks the cover 4 from the enclosure door 2 by freeing the clips 7, 8, locks simultaneously the cover 4 to the fastening part 6 by means of the clips 12, 13 and also unlocks the fastening part 6 from the enclosure 1 by freeing the clips 14, 15.

The enclosure door 2 and the fastening part 6 are in each case provided with a respective closure seal 16, 17 of a double action nature and having a substantially planar side, respectively 39 and 40, and a slightly conical side, respectively 41 and 42. The substantially planar sides 39 and 40 are exposed to the outside when the container 3 is detached from the enclosure, but respectively bear on the cover 4 of the container 3 and on the enclosure fastening 18 of the opening of the enclosure wall 1 when coupling is established. Therefore they are never exposed to contamination when the cover 4 and enclosure door 2 are open. The slightly conical sides 41 and 42 are then contaminated, but they respectively bear on a surface of the enclosure fastening 18 and on a surface of the cover 4 when the latter and the door 2 are put back into place and then separated, so that there is no dirtying from the outside. The seals 16, 17 are in contact by a crest having a negligible width located at the junction of these sides.

There will be a return to FIGS. 1 and 2 for a description of the original parts of the invention.

The receptacle 5 is constituted by a cylindrical wall 19 and a bottom 20 and it has a circular section encircling that of the cover 4, whilst being significantly more extensive of the latter and offcentred with respect thereto. The interior of the receptacle 5 is subdivided into cavities 21 by radiating partitions 22. The cavities 21, whose sections correspond to adjacent quadrants, can be successively placed in front of the cover 4. Their dimensions are chosen in such a way that only one cavity can be placed at the same time in front of the cover 4.

Thus, the interior of the receptacle 5 is occupied by a rotary drum 45 constituted by a central spindle 46, having relatively narrow, peripheral circular walls 47 and radiating partitions 22, which join the circular walls 47 to one another and to the central spindle 46. The spindle 46 is coaxial to the receptacle 5 and extends virtually over its entire length. It also passes through the bottom 20 and widens on the outside to form a disk 48 provided with axial cutouts 49. The disk 48 is located in a circular depression 50 of the bottom 20, in which there are further cutouts 51 able to extend the cutouts 49.

An O-ring 52 engages round the spindle 46 on passing through the bottom 20 and therefore isolates the interior from the container 3. Finally, the circular walls 47 of the rotary drum 45 rest on that 19 of the receptacle 5 whilst maintaining a perfect centring of the drum 45 in the receptacle 5.

Generally the container 3 is used after placing it on an elevating table 54 belonging to a known apparatus type. Two supports 55, 56 are screwed to the elevating table 54 in order to support the container 3. The first, which is close to the cover 3, is indented and carries on its sides two surfaces 57 tangential to the same circle and on which bears, whilst being able to rotate, a flange 58 of the fastening part 6, centred on the cover 4. The second carries a support pin 59 of the lower generatrix of the receptacle 5 below the bottom 20, an indexing pin 60 in the axis of the cover 4 and which can be inserted in a recess 61 of the bottom 2 and can be withdrawn therefrom by pulling on a handle 62, and a key or wrench 63, which is used for turning the drum 45. It is constituted by a spindle 64 coaxial to the spindle 46 and whose opposite ends carry a manipulating wheel 65 and a fork 66. The spindle 64 is longer than the cutout of the support 56 in which it is engaged. It is able to slide therein as well as rotate and it has grooves 67 in which can be introduced an eccentric disk 68 mounted on the support 56 in order to block the spindle 64 in three positions. In the first position illustrated in FIG. 1, the fork 66 is in front of the disk 48 without touching it, so that the container 3 can be placed on the supports 55 and 56 or can be removed therefrom, after retracting the indexing pin 60. In the second position where the lugs or teeth 69 of the fork 66 have entered the cutouts 49, 51, the drum 45 is locked in the receptacle 5, which makes it possible to easily load or unload the cavity 21 in front of the opening of the container 3. In the third position, between the first and second positions, the lugs 69 only penetrate the cutouts 49 of the disk 48. The receptacle 5 is still blocked and the drum 45 rotates with the manipulating wheel 65 in order to successively bring the cavities 21 in front of the cover 4. The receptacle 5 remains stationary, blocked by the indexing pin 60.

A mobile lever 70 provided with pins 71 engaged in two cutouts 72 of the bottom 20 ensures an overall rotation of the container 3 when the key 63 is in the first position, for locking and unlocking the clips 14, 15 or placing the container 3 in the desired angular position, where the recess 61 extends in front of the indexing pin 60.

FIG. 4 illustrates a stage of the filling of the container 3 during which the enclosure door 2 and the cover 4 are removed and put aside, one of the cavities 21, at the bottom in the drawing, having been filled by two roughly cylindrical cutting residues stacked horizontally therein. It is then necessary to rotate the drum 45 in order to bring a new cavity 21 in front of the opening of the container 3 and therefore place the others partly in front of the fastening part so that their content cannot escape.

A much greater filling level than for known containers is obtained, particularly if the cavities 21 have shapes and dimensions adapted to the objects which they have to receive. Said objects are e.g. constituted by solid nuclear waste. Moreover, the elevating table 54 equipped with supports 55, 56 offers excellent manipulation possibilities.

I claim:

1. Tight container (3) constituted by a cover (4), an envelope (5) on an opening of which is mounted the cover (4), the opening being offset with respect to a median axis of the envelope, and a drum (45) rotating in the envelope about the median axis, the drum being subdivided into offset compartments (21) and able to come successively in front of the opening when the drum rotates, characterized in that the envelope (5) carries a fastening part (6) equipped with means (14) for locking to an enclosure wall, the drum (45) being terminated by a disk (48) outside the envelope (5), centred on the median axis and positioned, along said median axis, on a side (20) opposite to the opening, the disk (48) being provided with cutouts (49) for receiving pins (69) of the key (63) and covering an envelope portion provided with other cutouts (51) for receiving pins of the key (69) able to extend the cutouts (49).

2. Tight container according to claim 1, characterized in that the drum (45) is constituted by a spindle (46) rotating in the envelope and carrying the disk (48), cylindrical walls (47) resting on the envelope (5) and radiating partitions (22) separating the compartments (21) and joining the cylindrical walls (47) to the spindle (46).

3. Assembly constituted by a container according to any one of the claims 1 or 2 and a support for said container, characterized in that the key (63) is located on the support, constituted by a spindle (64) rotating in said support, a fork (66) provided with lugs (69) directed towards the cutouts (49, 51) and a wheel (65) for turning said key, the wheel and the fork being located at opposite ends of the spindle (64).

4. Assembly according to claim 3, characterized in that the support comprises pins (59) or circular arc surfaces (57) for supporting the container (3).

5. Assembly according to claim 3, characterized in that the support comprises an indexing pin (60) for the receptacle (5) offcentred with respect to the median axis of the latter.

6. Assembly according to claim 3, characterized in that the spindle (64) of the key (63) is provided with grooves (67) for receiving a cam (68) of the support.

* * * * *

UNITED STATES PATENT AND TRADEMARK OFFICE

CERTIFICATE OF CORRECTION

PATENT NO. : 5,413,242

DATED : May 9, 1995

INVENTOR(S) : Orange

It is certified that error appears in the above-indentified patent and that said Letters Patent is hereby corrected as shown below:

On the title page, the following information should be inserted with respect to the assignee: --Compagnie Generale Des Matieres Nucleaires, Velizy Villacoublay, France--.

On the title page, the following information should be inserted with respect to the Attorney, Agent or Firm: --Pearne, Gordon, McCoy & Granger--.

Signed and Sealed this

Nineteenth Day of March, 1996

*Attest:*

Bruce Lehman

BRUCE LEHMAN

*Attesting Officer*

*Commissioner of Patents and Trademarks*